United States Patent [19]

Hawley

[11] Patent Number: 4,966,258

[45] Date of Patent: Oct. 30, 1990

[54] COMBINATION LUGGAGE, TABLE AND VANITY

[76] Inventor: Marilyn J. Hawley, 1905 "G" St., Apt. #15, Lincoln, Nebr. 68510

[21] Appl. No.: 365,296

[22] Filed: Jun. 13, 1989

[51] Int. Cl.[5] ..... A45C 9/00; A45C 15/04; A47B 3/10

[52] U.S. Cl. ..... 190/4; 190/6; 190/12 R; 190/18 R; 206/542; 206/549; 312/227; 312/240; 312/244

[58] Field of Search ..... 190/1, 3, 12 R, 6, 4, 190/11, 18 R; 206/549, 581, 542; 312/227, 240, 290, 244; 297/17

[56] References Cited

U.S. PATENT DOCUMENTS

| | | | |
|---|---|---|---|
| 74,783 | 2/1868 | Hunderlich | 190/3 |
| 380,038 | 3/1888 | Holt | 312/290 X |
| 577,204 | 2/1897 | Patten | 312/227 X |
| 988,937 | 4/1911 | Holland | 190/3 X |
| 1,034,377 | 7/1912 | Wesson | 206/549 |
| 1,361,101 | 12/1920 | Santoro | 312/240 X |
| 1,492,854 | 5/1924 | Larsen | 190/3 X |
| 1,725,550 | 8/1929 | Tharp | 190/3 |
| 2,521,572 | 9/1950 | Eckel et al. | 312/290 X |
| 3,156,510 | 11/1964 | Hindin et al. | 312/227 X |
| 4,195,889 | 4/1980 | Coyne | 190/12 R X |

FOREIGN PATENT DOCUMENTS

| | | | |
|---|---|---|---|
| 2847209 | 5/1980 | Fed. Rep. of Germany | 190/3 |
| 604781 | 5/1926 | France | 190/12 R |
| 1309200 | 10/1962 | France | 312/290 |
| 162102 | 8/1933 | Switzerland | 297/17 |
| 349380 | 5/1931 | United Kingdom | 190/12 R |
| 355803 | 8/1931 | United Kingdom | 190/12 R |

*Primary Examiner*—Sue A. Weaver
*Attorney, Agent, or Firm*—Vincent L. Carney

[57] ABSTRACT

To permit combination luggage, table and vanity to have a luggage position, a table position and a vanity position, the combination includes a handle mounted to one of a back side, right side and left side for carrying said combination luggage, table and vanity when in the luggage position. A hinge pivotally connects a rear edge of a top wall to a top edge of the back wall wherein the top wall may lie horizontal when said combination is in the table position and extends vertically when in the vanity position. A hinge pivotally connects a bottom edge of said back wall to a rear edge of said bottom wall and a hinge pivotally connects a front edge of the bottom wall to a bottom edge of said front wall wherein said bottom wall and said front wall are closable in the luggage position but openable to expose a compartment under said bottom wall, whereby a stand and stand legs may be stored in the compartment and to expose drawers in the front which may be used in the vanity position.

14 Claims, 2 Drawing Sheets

FIG. 1
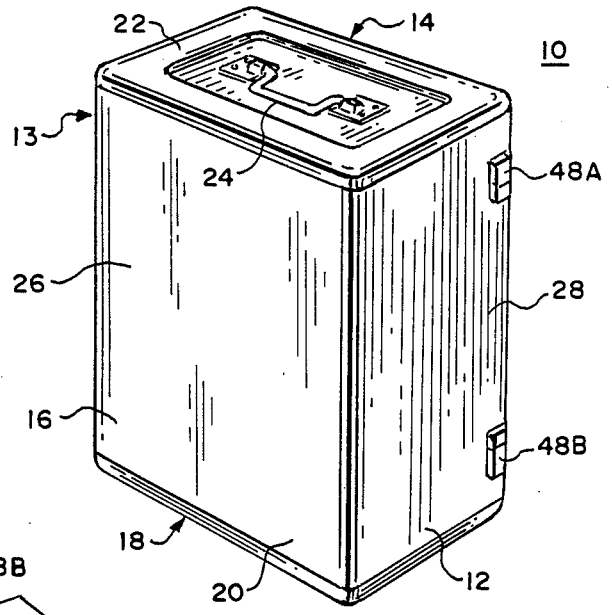
FIG. 2
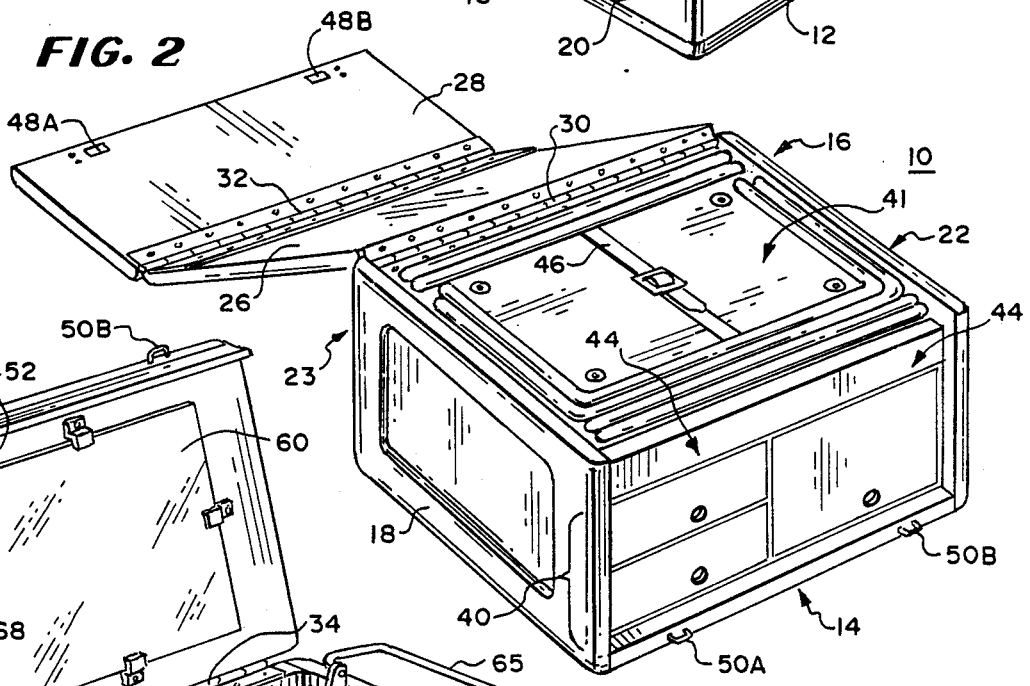
FIG. 3

COMBINATION LUGGAGE, TABLE AND VANITY

BACKGROUND OF THE INVENTION

The invention relates to portable furniture and more specifically to multiple purpose furniture including a vanity which may be packaged in a form for easy transportation.

Foldable tables, dressers and vanities are known in the prior art. One such prior art foldable dresser disclosed in U.S. Pat. No. 1,725,550 issued on Aug. 20, 1929 to Tharp may be folded into a large trunk of the type mounted to automobiles at that time and unfolded into a dresser. Moreover, it is known from U.S. Pat. No. 2,584,048 to equip suitcases with drawers useable for separate storage and access to the stored items.

The prior art portable furniture has several disadvantages such as not being sufficiently small to easily carry as hand luggage on an aircraft nor expandable to provide full vanity and storage capacity.

SUMMARY OF THE INVENTION

Accordingly, it is an object of the invention to provide a novel combination luggage and vanity system.

It is a further object of the invention to provide a portable vanity which may be put into a form sufficiently small to fit under ordinary airline seats and yet expand to accommodate normal grooming activities.

It is a still further object of the invention to provide a novel combination luggage, table and vanity which is easy to fold into the luggage form and unfold into a position which serves one or more of several purposes.

According to the above and further objects of the invention, a combination luggage and vanity includes a main housing with a top wall which may be lifted up to hold a mirror and provide a working surface, a bottom compartment which may be opened to permit expansion into shelves and the storage of a stand and a front section capable of holding drawers, one of which is large enough to serve as a small wash basin and constructed to be water tight. A towel rack is foldable to and from the working surface to accommodate a towel.

The folded combination luggage and vanity is sized to fit under airline seats and has a recessed handle and rounded corners for easy storage under seats. When the bottom storage compartment is opened to provide access to the stored stand and shelves, the cover hangs downwardly to form a back for the shelves and the top of the stand fits in the compartment so as to form a sturdy structure.

As can be understood from the above description, the combination luggage, table and vanity 10 of this invention has several advantages such as: (1) it may be used as a convenient size piece of luggage to move it from place to place even as carryon luggage in conventional aircraft; (2) it is adaptable to being used as a vanity which may sit on another table or the like; or (3) it may be conveniently used as a self-standing table or vanity.

SUMMARY OF THE DRAWINGS

The above noted and other features of the invention will be better understood from the following detailed description when considered with reference to the accompanying drawings in which:

FIG. 1 is a perspective view of the combination luggage, table and vanity packaged for use and transportation as luggage;

FIG. 2 is a perspective view showing the bottom of the combination luggage, table and vanity with the bottom storage compartment open to expose shelves and a stand;

FIG. 3 is a perspective view of the combination luggage, table and vanity opened in a position where it may be used as a vanity while sitting on a stand or table or the like;

DETAILED DESCRIPTION

Figure 4:
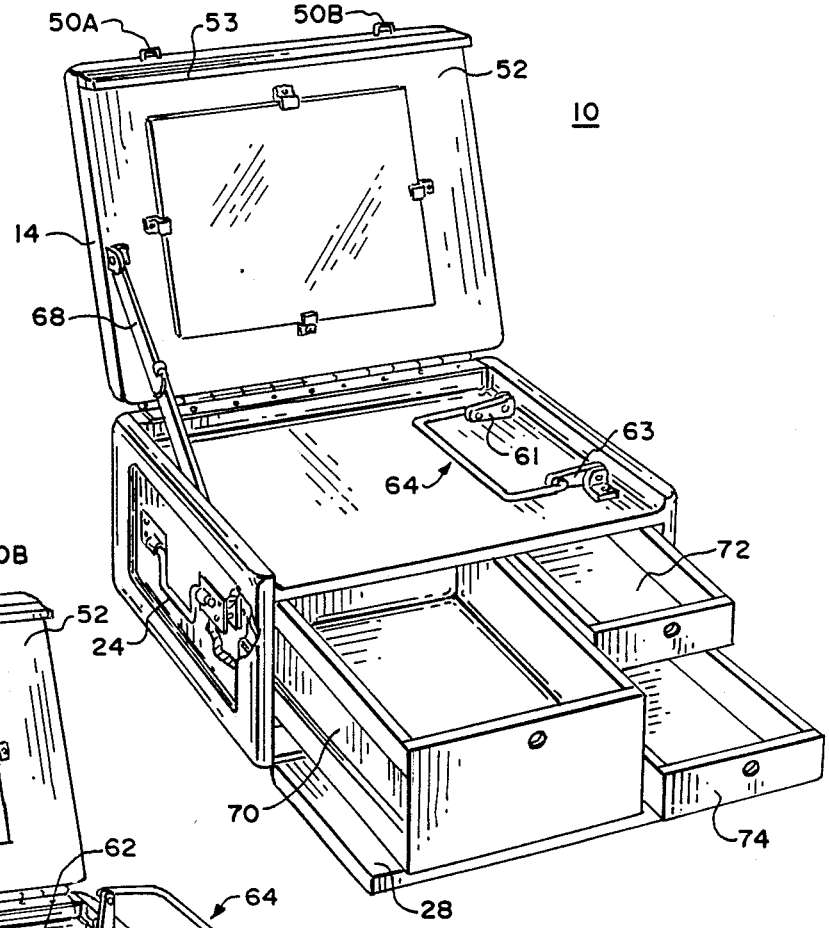
FIG. 4 is a perspective view of the combination luggage, table and vanity with the drawers opened.

In FIG. 1, there is shown a perspective view of a combination luggage, table and vanity 10 shaped as a right regular parallelopiped dimensioned to fit under airline seats for easy travel and having dimensions when in its travel form no greater than 9 by 23 by 45 inches and in the preferred embodiment of 8½ inches×14 inches×20 inches. It includes a handle and may be easily carried or stored in this form but expanded for use as a table or vanity when required. In the preferred embodiment, it stands 34 inches but the working surface of the vanity should be within a range of 24 inches to 40 inches from the ground.

The luggage form for travel includes a front side 12 (as a vanity shown in FIGS. 3–5), a top side 14, a bottom side 16, a right side 18, a left side 22, and a back side 13. The designation of top, bottom, right, left and back are made in accordance with the use of the combination luggage, table and vanity as a table or vanity.

To permit it to be easily carried, it includes on its left side 22, a conventional handle 24 extending upwardly from a recess in the left side to permit easy storage without interference of the handle but still permitting easy holding. The bottom side 16 is closed by a bottom wall 26 having an outer surface 20. The bottom wall 26 is hinged to the housing by an internal hinge shown in FIG. 2 at 30 and the front is covered by a front cover wall, hinged to the bottom wall 26 at a corner location by a front internal hinge 32 for the front cover shown in FIG. 2. A top wall 52 is hinged with an internal hinge 34 as shown in FIG. 3.

As best shown in FIG. 2, the combination luggage, table and vanity 10 may have its bottom side 16 opened to expose shelves and leg assemblies stored therein. In this position, the front wall 28 and the bottom wall 26 are opened by pulling apart the snaps 48A and 48B on the front wall 28 from the matching snaps 50A and 50B on the cover or top wall 52 and unfolding the front wall 28 and bottom wall 26 to expose an inner compartment 41 in which shelves and legs are held by a strap 46. In this position, the front surface 40 is also exposed to show a set of drawers 44.

The strap or belt 46 permits shelves stored in the compartment to be held in place while the combination luggage, table and vanity 10 is used as a table or as a vanity if desired. In the alternative, the belt may be released to permit the shelves to drop into place in a manner to be described hereinafter.

The bottom wall 26 is held to the back wall 23 by an internally mounted elongated metal hinge 30 and the end of the bottom wall 26 is pivotally mounted to the front wall 28 by an elongated metal hinge 32. The shelves are sized smaller than the opening in the compartment to permit the stand to fit therein.

In FIG. 3, the combination luggage, table and vanity 10 is shown in an opened position where it may rest upon a table or other support for use and having its top wall 52 in the top side 14 opened. In this position, there is exposed the inner surface of the top wall 52, a mirror 60, a flat horizontal working surface 62, a towel rack 64 and a drawer section 44. The mirror is replaceably fastened to the front side of the cover wall 52 so that when the cover wall 52 is open, the mirror 60 faces forwardly for use.

The cover wall 52 is held in this position by a toggle arm 68 formed of two struts pivotably mounted together at a center portion and having their distal ends pivotally mounted to a different one of the cover wall 52 and side wall of the luggage to permit the cover wall 52 to be closed or to hold it open. The towel rack 64 includes first and second upstanding supports 61 and 63 and a U-shaped member 65. The first and second upstanding supports 61 and 63 are mounted to the working surface 62 and extend upwardly substantially as high as the lip of the combination luggage, table and vanity 10 that extends above the working surface 62. The U-shaped member 65 has each of its two legs pivotably fastened to a different support so the U-shaped member 65 may be pivoted inwardly under the cover wall 52 for storage or pivoted outwardly over its edge to support a towel outside the confines of the flat horizontal working surface 62. The U-shaped member 65 in its outward position rests on the upstanding lip so as to be substantially horizontal.

To store clothing, cosmetics, soap or the like, the drawer section 44 includes a large drawer 70, a top small drawer 72 and a small bottom drawer 74 with the top and bottom drawers together being next to the large drawer 70 and beneath the working surface 62. When the combination luggage, table and vanity 10 is used as luggage, clothing may be stored on the working surface 62. The lip 71 extends above the working surface 62 on all sides except the front to permit more easy access to the working surface. A downwardly extending flange 53 on the cover wall 52 meets the edge of the front wall 28 for latching in the luggage position to close the top against the front walls. The edges and corners are rounded including those between the lip 71 and the working surface 62 so as to be more easily cleaned.

With this arrangement, the combination luggage, table and vanity 10 may be supported on a raised surface such as a table so that the mirror 60 can be used for grooming and the drawers may contain supplies for such grooming. The large drawer, for example, may support a basin for water in this position or may itself serve as a basin.

In FIG. 4, the combination luggage, table and vanity 10 is shown in its open position but the towel rack 64 is pivoted inwardly for storage and the drawers are open to show their full exposure. As best shown in this view, the large drawer 70 is sufficiently large to serve as small water basin for use in camping or when other facilities are not available. It is integrally molded in the preferred embodiment to be water tight but may be made in other ways and then sealed.

Figure 5:
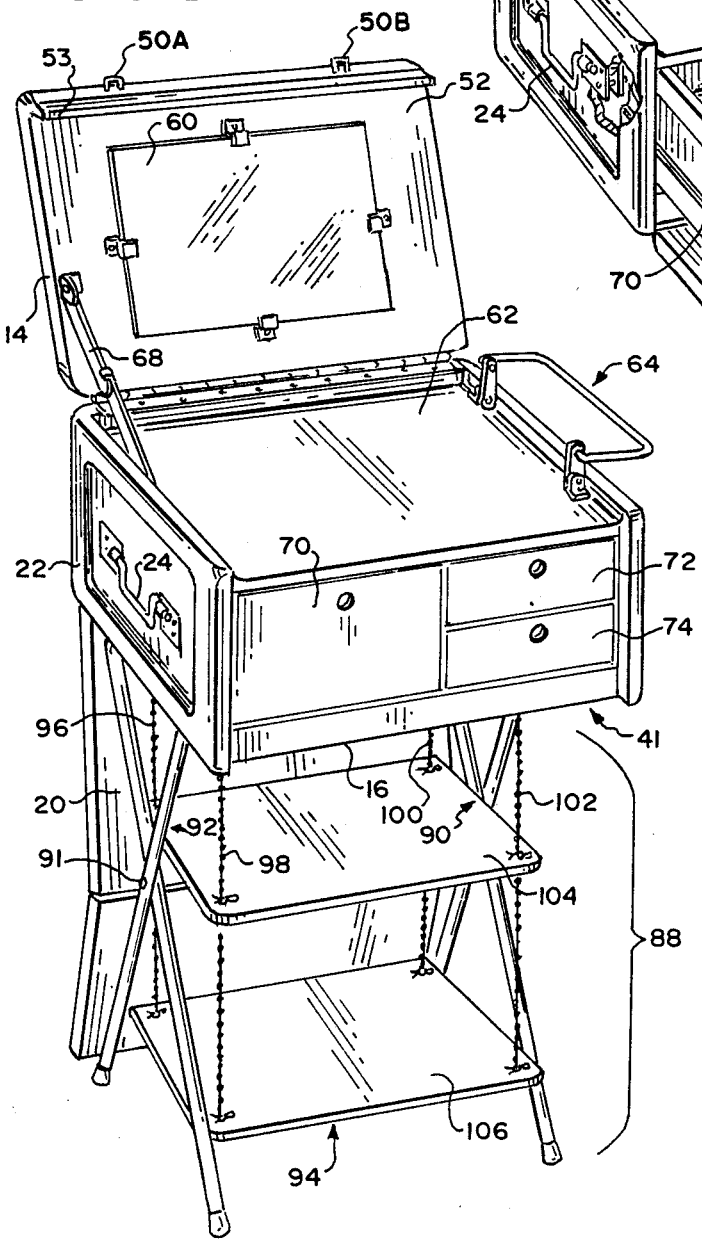
FIG. 5 is a perspective view of the combination luggage, table and vanity on its own stand.

In FIG. 5, there is shown the combination luggage, table and vanity 10 in its self-supporting open position resting upon the stand 88 formerly enclosed within the bottom compartment 41 (FIG. 2) so that the mirror 60 faces forwardly for use, with the towel rack 64 being available to hang towels on and the horizon al working surface 62 being free for use. The stand 88 includes a pair of right legs 90, left legs 92 and a shelving assembly 94. The right and left legs 90 and 92 open outwardly and support the drawers and mirror section while the shelving assembly 94 hangs between them with the bottom wall and front wall hanging downwardly behind the two.

To support the drawers, mirror and working surface, the right and left legs of the stand 88 may be spread apart by pivoting them at pivot points 91 and 93 (FIG. 6) so that there are upper supports extending along the bottom of the housing parallel to each other spaced sufficiently far apart to support the bottom and four lower support points to provide a stand. The bottom portions of the legs 90 and 92 are removable to reduce the size of the unit for fitting within the compartment 41 of the bottom 16 (FIG. 2).

To provide extra shelf space, the shelving assembly 94 includes four chains 96, 98, 100 and 102 and two shelves 104 and 106. Each of the chains 96, 98, 100 and 102 have a corresponding one of their ends fastened to the bottom 16 of the combination luggage, table and vanity 10 with their points of attachments forming a square slightly smaller than the square upper surfaces of the shelves 104 and 106. Thus, when not stored in the bottom compartment 41, they hang downwardly and are fastened to the chains by cotter pins above and below the shelves at corresponding four locations and the shelve 104 at a selected point substantially 1½ feet along the length of the chain, which is the midpoint of each of the chains 96, 98, 100 and 102. The lower shelf 106 is fastened at corresponding four points by cotter pins at the ends of the chains which are approximately 3 feet long. In the preferred embodiment the shelves are 11 and one quarter inches by 15 inches and three quarters inch in surface area and one-quarter inch thick.

Figure 6:
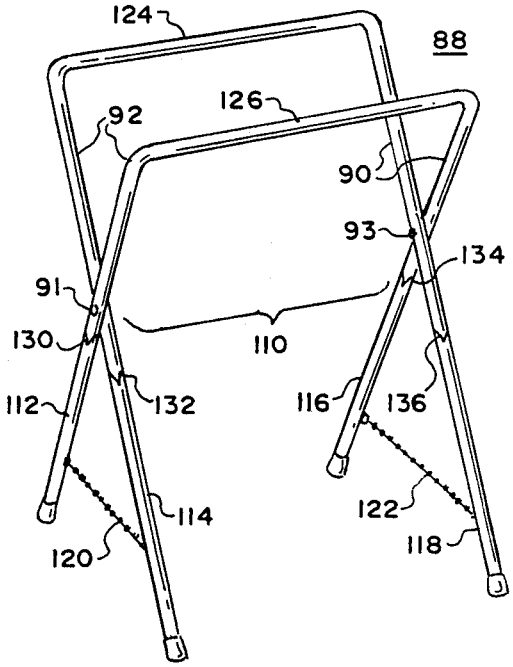
FIG. 6 is a perspective of the stand which is a component part of the embodiment of FIGS. 1–5.

In FIG. 6, there is shown a perspective view of the stand 88. To support the vanity or table, the stand 88 includes a top section 110, four bottom leg portions 112, 114, 116 and 118 and first and second flexible binders 120 and 122. The top member 110 is formed of two inverted U-shaped tubes 124 and 126 with the left leg portions of the left ends of the tubes 124 and 126 being pivoted together at 91 and the right leg portions of the left ends of the tubes 124 and 126 being pivoted together at 93. Each of the lower portions telescope with each of corresponding ones of the legs 112, 114, 116 and 118 at the connecting points 130, 132, 134 and 136. At these points, the lower end members of the legs may be disassembled, the upper portion folded together and all of the portions stored in the bottom compartment 41 of the combination luggage, table and vanity 10 (FIG. 2).

To hold the stand firmly when it is supporting the remainder of the combination as a table or as a vanity, the top portions of the tubes 124 and 126 fit tightly into the compartment 41 (FIG. 2) to confine the top of the inverted U of the U-shaped tubes. The flexible members 120 and 122 are chains in the preferred embodiment mounted permanently at one end to a leg and connectable to a hook at at selected link at the other end of the chain. With this structure the stand fits in the direction along the top of the compartment because of the prefabricated lengths of the tops and the compartment and the orthogonal distance between the top portions is adjusted by the chains to fit in the other direction so that the top of the stand holds the stand firmly in place when used as a table or vanity.

In use, the combination luggage, table and vanity may be moved conveniently from place to place in the manner of a small suit case. It may be treated as carry-on luggage during a flight and yet may be opened into a self-standing vanity or table at the location where it is to be used. When traveling or when using it, it may have stored within it other supplies such as grooming supplies within the drawers and clothing on the working surface.

To move the combination luggage, table and vanity 10 from place to place conveniently, the stand 88 is disassembled by removing the leg portions and folding them together and the shelves are moved into the bottom compartment 41 by dropping them into the bottom compartment 41 while the bottom is open. The bottom wall 26 (FIGS. 1 and 2) is then folded over to close the bottom compartment 41 and folded over the front, being snapped in place to the top wall 52 (FIG. 3). The towel rack 64 (FIG. 5) is folded in against the working surface 62 (FIGS. 3, 4 and 5) and the top is moved downwardly and snapped.

When the combination luggage, table and vanity 10 is compactly folded together and snapped shut, it may be picked up by the handle 24 and moved conveniently from place to place. It may be stored under the standard space allotted in an aircraft such as under the seat in front or overhead storage bins as well as being carried in automobile trunks and the like conveniently.

To use it in a room having a table or other support, the top may be independently opened. The bottom may be opened and the front wall unsnapped to expose the drawers. In this position, the front wall 28 would lay on a table extending outwardly from the drawers and the cover wall 52 would be opened, exposing a mirror 60 which can be viewed. In this position, the towel rack 64 (FIGS. 3, 4 and 5) may be moved outwardly to support a towel.

To use the combination luggage table and vanity 10 as a self-standing support, the front wall member 28 is unsnapped and then the bottom wall member 26 unsnapped. The belt is undone and the parts of the stand 88 removed.

To assemble the stand 88, the four bottom leg portions 112, 114, 116 and 118 are telescoped into the upper portion and the legs spread apart. The bottom wall 26 may then be placed on top of the stand 88 with the front wall 28 and bottom wall 26 hanging downwardly to a location near the ground from the top of the stand to form a backing for the shelves if they are used. The shelves however may be held in place with the belt 46 if desired. The legs of the stand 88 are spread until the top of the stand is confined against the walls of the compartment 41 to hold it in place. In this position, the combination luggage, table and vanity 10 may be used as a table such as at a picnic or the like or to write on or for any other purpose. There is free access to the drawers.

If it is desirable to use the combination luggage, table and vanity 10 as a vanity, the top wall 52 is also unsnapped and opened so that the mirror 60 faces forwardly. The towel rack 64 may then be moved outwardly and it may be used in the same manner as when it is resting on a table. The large drawer 70 may be filled with water and used as a basin.

As can be understood from the above description, the combination luggage, table and vanity 10 of this invention has several advantages such as: (1) it may be used as a convenient size piece of luggage to move it from place to place even as carryon luggage in conventional aircraft; (2) it is adaptable to being used as a vanity which may sit on another table or the like; or (3) it may be conveniently used as a self-standing table or vanity.

Although a preferred embodiment of the invention has been described with some particularity, many modifications and variations in the preferred embodiment may be made without deviating from the invention. Therefore, it is to be understood that, within the scope of the appended claims, the invention may be practiced other than as specifically described.

What is claimed is:

1. A combination luggage, table and vanity having a luggage position, a table position and a vanity position comprising:

a front wall;

left and right-hand sides;

a back wall;

one of said back wall, right side and left side having a handle thereon for carrying said combination luggage, table and vanity when in the luggage position;

a top wall;

a first hinge means for pivotally connecting a rear edge of the top wall to a top edge of the back wall wherein the top wall may lie horizontal while said combination is in the table position and extend vertically when in the vanity position;

latch means removably connecting the front edge of said top wall to the top edge of said front wall, whereby said top wall and front wall may be held closed when the combination luggage, table and vanity is in the luggage position;

a bottom wall;

a second hinge means for pivotally connecting a bottom edge of said back wall to a rear edge of said bottom wall;

a third hinge means for pivotally connecting a front edge of the bottom wall to a bottom edge of said front wall wherein said bottom wall and said front wall are closable when the combination luggage, table and vanity is in the luggage position;

internal walls forming a storage compartment closed by said bottom wall, whereby a stand may be stored;

drawers in a front side of said combination luggage, table and vanity behind said front wall, whereby said front wall may be pivoted about said third hinge means to expose said drawers when the combination luggage, table and vanity is in the vanity position;

said combination luggage, table and vanity having dimensions no greater than $9 \times 23 \times 45$ inches when in the luggage position.

2. A combination luggage, table and vanity in accordance with claim 1 further including a stand; said stand including a top section formed of a pair of inverted U-shaped members joined by pivot means, said inverted U-shaped members including open free end portions, and a bottom section, said bottom section including straight members shaped to be inserted into said open free end portions of said inverted U-shaped members, whereby said stand may have said straight members removed and said U-shaped members folded together about their pivot means for storage in said storage compartment.

3. A combination luggage, table and vanity in accordance with claim 2 including four flexible members each of which has a corresponding one of its ends attached to said internal walls forming said compartment and first and second shelf means; said first shelf means having a first flat surface of a horizontal dimension smaller than the horizontal dimensions of the stand when erected and a first set of four spaced-apart points; each of said four spaced-apart points in said first set being attached to a different one of said four flexible members at a corresponding point of a first set of corresponding points on said four flexible members forming a corresponding first set of lengths from corresponding one of its ends of said four flexible members; each length of said first set of lengths being equal in length to the other lengths of said first set of lengths; said second shelf means having a second flat surface of a horizontal dimension smaller than the horizontal dimensions of the stand when erected and a second set of four spaced-apart points; each of said four spaced-apart points in said second set being attached to a different one of said four flexible members at a corresponding point forming a corresponding second set of lengths from the corresponding one of said first set of corresponding points of said four flexible members; each length of said second set of lengths being equal in length to the other lengths of said second set of lengths, whereby said combination luggage, table and vanity when set on the stand with the front wall and bottom wall open and the stand top section received in the open storage compartment may have the shelf means depending beneath it.

4. A combination luggage, table and vanity in accordance with claim 3 which when in said luggage position has dimensions of 8½ inches × 14 inches × 20 inches.

5. A combination luggage, table and vanity in accordance with claim 4 further including a horizontal working surface; said horizontal working surface being above said drawers wherein it is exposed when said combination luggage, table and vanity is in the vanity position; a towel rack; said towel rack including first and second upstanding support members fastened to said working surface near an edge of the working surface and extending upwardly therefrom; a U-shaped rack member having first and second legs and first and second pivot points connecting corresponding ones of said first and second upstanding members to said first and second legs of said U-shaped rack members whereby said U-shaped member may pivot between a position on the working surface to permit storage of the rack and a position extending over the edge of the working surface to permit use of the towel rack.

6. A combination luggage, table and vanity in accordance with claim 1 further including:

an erectable stand means for supporting said luggage, table and vanity;

four flexible members each of which has a corresponding one of its ends attached to said internal walls forming said compartment; and first and second shelf means;

said first shelf means having a first flat surface of a horizontal dimension smaller than the horizontal demensions of the stand means when erected and a first set of four spaced-apart points;

each of said four spaced-apart points in said first set being attached to a different one of said four flexible members at a corresponding point of a first set of corresponding points on said four flexible members whereby a corresponding first set of lengths of flexible members from said internal walls is defined;

each length of said first set of lengths being equal in length to the other lengths of said first set of lengths;

said second shelf means having a second flat surface of a horizontal demension smaller than the horizontal dimensions of the stand means when erected and a second set of four spaced-apart points;

each of said four spaced-apart points in said second set being attached to a different one of said four flexible members at a corresponding point forming a corresponding second set of lengths from said internal walls;

each length of said second set of lengths being equal in length to the other lengths of said second set of lengths and different than said first set of lengths, whereby said combination luggage, table and vanity when set on the stand means with the front wall and bottom wall open and the stand means which includes a top section received in the open storage compartment may have the shelf means depending beneath it.

7. A combination luggage, table and vanity in accordance with claim 6 which when in said luggage position has dimensions of 8½ inches × 14 inches × 20 inches.

8. A combination luggage, table and vanity in accordance with claim 7 further including:

a horizontal working surface;

said horizontal working surface being above said drawers wherein it is exposed when said combination luggage, table and vanity is in the vanity position;

a towel rack;

said towel rack including first and second upstanding support members fastened to said working surface near an edge of the working surface and extending upwardly therefrom and a U-shaped rack member;

said U-shaped rack member having first and second legs and first and second pivot points;

said first and second pivot points connecting corresponding ones of said first and second upstanding support members to said first and second legs of said U-shaped rack member whereby said U-shaped rack member may pivot between a position on the working surface to permit storage of the U-shaped rack member and a position extending over the edge of the working surface to permit use of the towel rack.

9. A combination luggage, table and vanity in accordance with claim 1 which when in said luggage position has dimensions of 8½ inches × 14 inches × 20 inches.

10. A combination luggage, table and vanity in accordance with claim 9 further including:

a horizontal working surface;

said horizontal working surface being above said drawers wherein it is exposed when said combination luggage, table and vanity is in the vanity position;

a towel rack;

said towel rack including first and second upstanding support members fastened to said working surface near an edge of the working surface and extending upwardly therefrom and a U-shaped rack member;

said U-shaped rack member having first and second legs and first and second pivot points;

said first and second pivot points connecting corresponding ones of said first and second upstanding support members to said first and second legs of said U-shaped rack member whereby said U-shaped rack member may pivot between a position on the working surface to permit storage of the U-shaped rack member and a position extending over the edge of the working surface to permit use of the towel rack.

11. A combination luggage, table and vanity in accordance with claim 1 further including:

a horizontal working surface;

said horizontal working surface being above said drawers wherein it is exposed when said combination luggage, table and vanity is in the vanity position;

a towel rack;

said towel rack including first and second upstanding support members fastened to said working surface near an edge of the working surface and extending upwardly therefrom and a U-shaped rack member;

said U-shaped rack member having first and second legs and first and second pivot points;

said first and second pivot points connecting corresponding ones of said first and second upstanding support members to said first and second legs of said U-shaped rack member whereby said U-shaped rack member may pivot between a position on the working surface to permit storage of the U-shaped rack member and a position extending over the edge of the working surface to permit use of the towel rack.

12. A method of using a combination luggage, table and vanity having a luggage position, a table position and a vanity position comprising the steps of:

carrying said combination luggage, table and vanity by a handle on one of a back wall, right side and left side when the combination luggage, table and vanity is in the luggage position;

pivotally moving a top wall from a horizontal position to a vertical position about a hinge means connecting a rear edge of the top wall and a top edge of the back wall wherein the top wall may lie horizontal when said combination luggage, table and vanity is in the table position and extends substantially vertically when in the vanity position;

latching a front edge of said top wall to a top edge of a front wall with a latch means, whereby said top wall and front wall may be held closed when the combination luggage, table and vanity is in the luggage position;

opening and closing a storage compartment by pivoting a front wall about a hinge means connecting a front edge of a bottom wall to a bottom edge of said front wall and pivoting the bottom wall about a hinge means connecting a bottom edge of said back wall to a rear edge of said bottom wall wherein said bottom wall and said front wall are closable in the luggage position;

storing a stand and stand legs in said storage compartment closed by said bottom wall;

using drawers disposed in a front side of said combination luggage, table and vanity behind said front wall when said front wall is pivoted about said hinge means to expose said drawers in the vanity position;

withdrawing stand parts from the compartment; and setting up said stand having a top section formed of inverted U's having their legs pivoted together by pivot means connecting the inverted U's and a bottom section including attachments to the legs, whereby said stand may be folded together about the pivot means for storage in said storage compartment.

13. A method according to claim 12 further including the steps of removing four flexible members each of which has a corresponding one of its ends attached to internal walls of said storage compartment and first and second shelf means attached to said four flexible members, whereby said combination luggage, table and vanity when set on the stand may have the shelf means depending beneath it.

14. A method according to claim 13 further including the step of pivoting a towel rack about a pivot means connecting the towel rack to a horizontal working surface from a location on said horizontal working surface when the combination luggage, table and vanity is in the vanity position outwardly in one direction over the edge of the working surface for use to hold a towel and inwardly against the working surface in another direction when the towel rack is being positioned to permit the combination luggage, table and vanity to be put into the luggage position.

* * * * *